US006095631A

United States Patent [19]

Suzumura et al.

[11] Patent Number: 6,095,631

[45] Date of Patent: Aug. 1, 2000

[54] INK JET RECORDING DEVICE

[75] Inventors: Noriyuki Suzumura; Hideyuki Kobayashi, both of Niigata, Japan

[73] Assignee: NEC Corporation, Tokyo, Japan

[21] Appl. No.: 08/986,750

[22] Filed: Dec. 8, 1997

[30] Foreign Application Priority Data

Sep. 12, 1996 [JP] Japan ..... 8-327414

[51] Int. Cl.[7] ..... B41J 2/165

[52] U.S. Cl. ..... 347/22

[58] Field of Search ..... 347/5, 22, 23, 347/29, 30, 33, 34

[56] References Cited

U.S. PATENT DOCUMENTS

| | | | |
|---|---|---|---|
| 5,177,505 | 1/1993 | Sugiura et al. | 347/22 |
| 5,757,387 | 5/1998 | Manduley | 347/2 |

FOREIGN PATENT DOCUMENTS

| | | |
|---|---|---|
| 0 526 209 A2 | 2/1993 | European Pat. Off. . |
| 0 532 300 A2 | 3/1993 | European Pat. Off. . |
| 0 676 291 A1 | 10/1995 | European Pat. Off. . |
| 59-014966 | 1/1984 | Japan . |
| 63-022656 | 1/1988 | Japan . |
| 3248845 | 6/1991 | Japan . |
| 3-234649 | 10/1991 | Japan . |
| 425467 | 1/1992 | Japan . |
| 5 116331 | 5/1993 | Japan . |
| 6 340082 | 12/1994 | Japan . |
| 6-344572 | 12/1994 | Japan . |
| 7-025034 | 1/1995 | Japan . |
| 7-125228 | 5/1995 | Japan . |
| 7-242000 | 9/1995 | Japan . |

*Primary Examiner*—N. Le
*Assistant Examiner*—Anh T. N. Vo
*Attorney, Agent, or Firm*—Sughrue, Mion, Zinn, Macpeak & Seas, PLLC

[57] ABSTRACT

An ink jet printer with a recording head having an ink jet slit for ejecting ink onto a recording sheet, a sheet feeder for carrying the recording sheet toward and from the recording head, a cleaner for cleaning the ink jet slit. The cleaner is activated by the movement of the sheet feeder while the recording sheet is not set on the recording head and the recording head is out of operation, for prevention of stain of the recording sheet and enhancement of the processing by the CPU for controlling the ink jet printer.

7 Claims, 4 Drawing Sheets

INK JET RECORDING DEVICE

BACKGROUND OF THE INVENTION (a) Field of the Invention

The present invention relates to an ink jet recording device, and more particularly, to an improvement of controlling an ink jet recording device for cleaning an ink jet slit of the ink jet recording head by removing foreign materials such as ink mists from the ink jet slit.

(b) Description of the Related Art

In an ink jet recording head of an ink jet recording device such as a printer or copying machine, the ink jet slit of the recording head for ejecting ink droplets onto a recording sheet is often closed or blocked by foreign materials such as ink mists, which causes malfunction of the recording head.

The foreign materials are usually removed by cleaning the ink jet slit during a recording operation of the recording head. A first cleaning operation is generally effected between the finish of a feed operation of a recording sheet and a start of the printing operation. After the printing is started, a timer counts the time length from the start of the printing, interrupts the length from the start of the printing, interrupts the printing operation and effects a second cleaning operation after a specified time length elapsed since the start of the printing. The printing and interrupting cleaning operations are alternately effected for the specified time intervals so long as the printing command continues.

Patent Publication JP-A-7(1995)-125228 proposes a cleaning process for the ink jet slit, wherein an ink ejection frequency during the printing operation is counted, and the start of the next cleaning operation is controlled based on the counted ejection frequency. The proposed method has an advantage in reducing the cleaning frequency during the printing operation to a minimum required for the ink jet slit.

In the proposed method as well as the conventional method, the start of the cleaning operation is judged by a computer or a controller which detect the timing of the cleaners by receiving a count signal and comparing the count with a specified value. The processing for the judgement in this manner by the computer generally reduces the throughput of the computer in processing other operations of the printer.

Moreover, there is a problem in that the cleaning operation during the interval between the printing operations tends to stain the recording sheet fed on the recording head and consumes a longer time length for the computer processing corresponding to the processing for the cleaning operation.

SUMMARY OF THE INVENTION

It is therefore an object of the present invention to provide an ink jet recording device capable of controlling the cleaning operation for the ink jet slit in a simple processing, thereby reducing the burden of the computer and enhancing the throughput of the computer for processing other operations on the recording device.

It is another object of the present invention to provide an ink jet recording device capable of preventing recording sheet from being stained by the cleaning operation in the ink jet recording device.

The present invention provides an ink jet recording device comprising a recording head having an ink jet slit for ejecting therethrough ink onto a recording sheet, a sheet feeder for feeding a recording sheet to or from the recording head, a cleaner, activated by a movement of the sheet feeder, for cleaning said ink jet slit.

In accordance with an ink jet recording head of the present invention, since the cleaner is activated by the movement of the sheet feeder, the control of the cleaner imposes less burden on the CPU controlling the ink jet recording device. Further, the recording sheet is less stained by the cleaning operation by the cleaner, because the cleaning can be effected in the absence of the recording sheet on the recording head.

The above and other objects, features and advantages of the present invention will be more apparent from the following description, referring to the accompanying drawings.

PREFERRED EMBODIMENTS OF THE INVENTION

Now, the present invention is more specifically described with reference to accompanying drawings.

Figure 1:
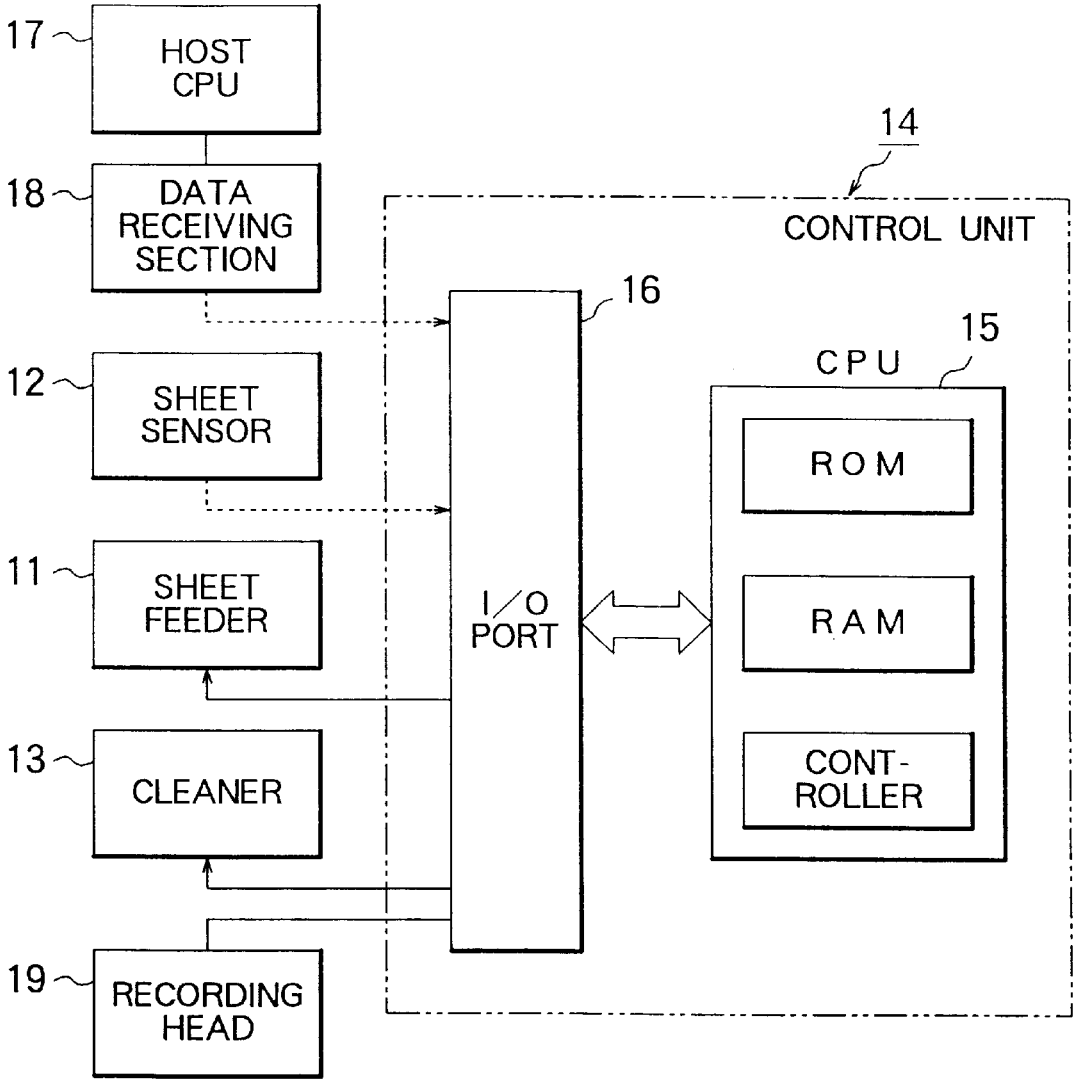
FIG. 1 is a block diagram of an example of an ink jet recording device according to the present invention.

Referring first to FIG. 1 showing an ink jet printer as an example of an ink jet recording device according to the present invention, the ink jet printer comprises a recording head 19 for recording print data on a recording sheet and a control unit 14 for receiving the print through a data receiving section 18 to control the recording head 19.

The ink jet printer also comprises a sheet carrier or sheet feeder 11 for transporting recording sheets from a sheet tray (not shown) to a recording head 19 and for discharging the sheets on the recording head toward outside the printer after the printing, and a sheet sensor 12 for detecting a recording sheet after a start of a feed operation by the sheet feeder 11. The sheet sensor 12 is implemented by a photocoupler, for example, and disposed at a suitable position in a feed passage or discharge passage for the recording sheet. The sheet feeder also effects for a smaller movement of the recording sheet, wherein the recording sheet is shifted line by line for a change line operation.

The sheet sensor 12 may be implemented by a mechanical sensor or any electric sensor instead for detecting the position of a carrier of the sheet feeder 11 carrying the recording sheet thereon. That is, it is sufficient that the start of the sheet is detected by a suitable element disposed in the sheet feeder for carrying the recording sheets. The sheet sensor may be implemented by a micro-switch instead of the photocoupler.

The recording head 19 records characters and images on the recording sheet based on a print data supplied from the host computer 17. A cleaner 13 implemented as a wiper blade, for example, is disposed at the ink jet slit of the recording head 19 for removing ink mists or other foreign materials from the ink jet slit for prevention of the block of the slit. The timing of the operation of the cleaner 13 is controlled by the control unit 14.

The control unit 14 comprises a CPU 15 including a ROM, a RAM, a microprocessor (or controller) and an I/O port 16. The CPU 15 conducts arithmetic calculation, comparison or other processing based on the print data and other signals received from the host computer 17 and a signal supplied from the sheet sensor 12 to control the recording head 19, sheet feeder 11 and cleaner 13.

The print data is stored in the RAM for a while and then delivered from the control unit 14 to the recording head 19 together with a printing mode signal. The recording head 19 ejects ink droplets onto the recording sheet based on the print data while reciprocally moving in the transverse direction of the recording sheet. The print data includes an end data which notifies the end of the print data supplied from the host computer 17.

Figure 2:
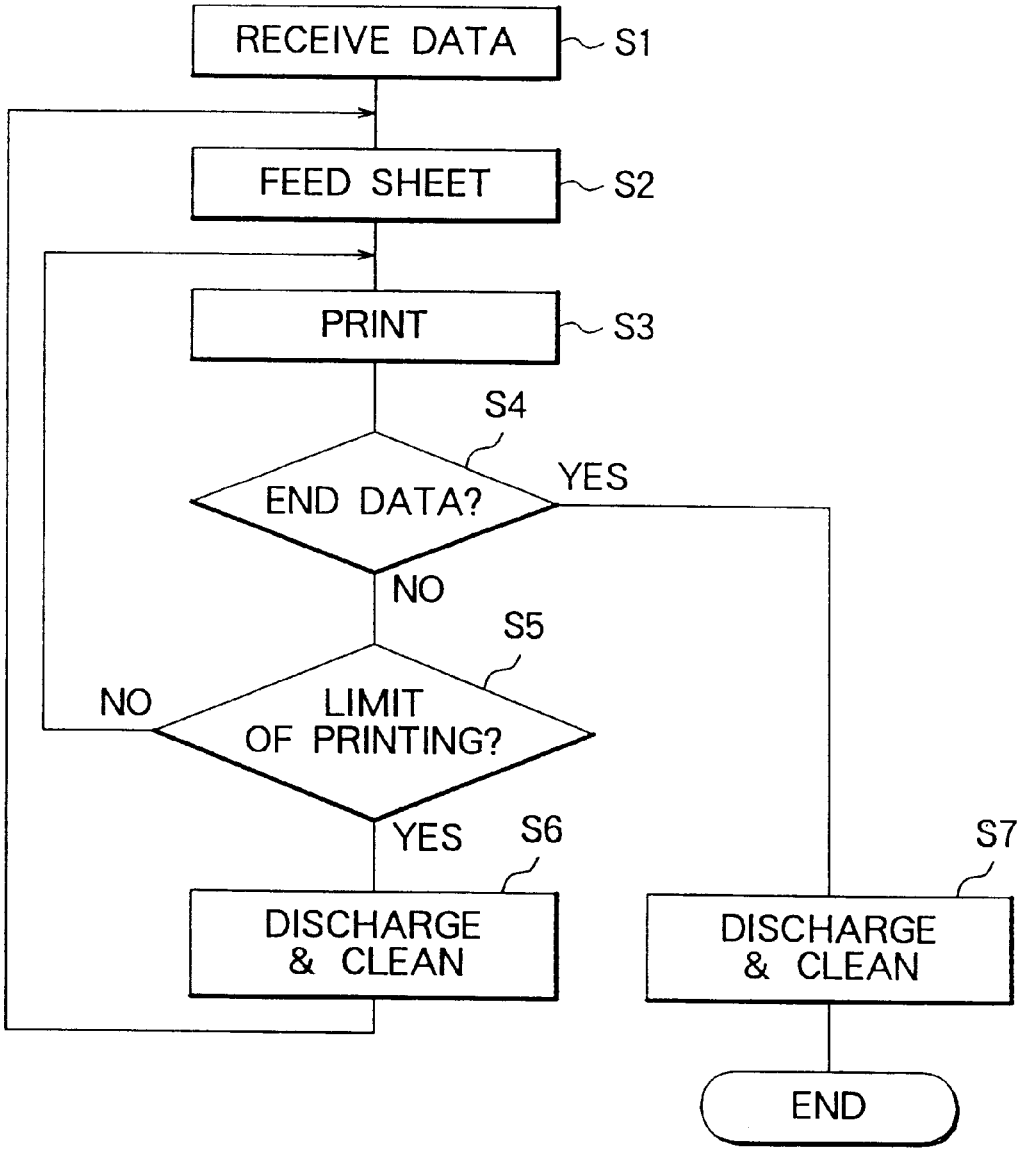
FIG. 2 is a flowchart of the cleaning operation of an ink jet recording device according to a first embodiment of the present invention.

Referring next to FIG. 2 showing a flowchart of the operation of an ink jet printer according to a first embodiment of the present invention such as shown in FIG. 1, the cleaning operation is effected by the cleaner 13 during a discharge of a recording sheet after the print data is recorded on the recording sheet. In this embodiment, the sheet sensor 12 is located in the discharge passage for the recording sheet.

Upon receiving print data from the host computer 17 at step S1 through the data receiving section 18, the CPU 15 conducts processing based on the print data and supplies a feed command signal to the sheet feeder 11.

The sheet feeder 11 then transports a recording sheet to the recording head 19 from the sheet tray through the feed passage at step S2. The CPU delivers the print data at step S3 line by line to the recording head 19 for printing characters or images based on the print data onto the recording sheet thus carried.

At step S4, if the next print data is not an end data, step S5 follows wherein it is examined whether or not the recording head 19 is located at the end of the sheet, usually at the bottom right of the sheet, wherein next print location is out of the limit for printing. If it is judged at step S5 that the recording head 19 is not located at the end of the sheet, the process returns to step S3 to repeat the steps S3 and S4. On the other hand, if it is judged at step S5 that the recording head 19 is located at the end of the sheet, step S6 follows wherein the recording head 19 stops operation and the sheet feeder 11 starts for discharging the sheet on the recording position.

The start of the discharge of the sheet is detected by the sheet sensor 12. The CPU 15 receives the detected signal from the sheet sensor 12 and delivers a cleaning signal to the cleaner 13 based on the detected signal. The cleaner 13 is activated for operation of removal of the ink mists or other foreign materials from the ink jet slit while the sheet feeder 11 discharges the recording sheet. In this manner, the discharge of the sheet and the removal of ink mists are operated concurrently while the recording head is out of operation. Then, the process returns to step S2 to repeat the steps S2 thorough S4 for a next sheet.

If it is detected at step S4 that the next data in the print data is an end data, the control unit 14 delivers a print end signal to the recording head 19 and the sheet feeder 11 to effect step S7, wherein the recording head stops operation and the sheet feeder discharges the last recording sheet from the recording head 19. The discharge of the sheet is detected by the sheet sensor 12, and the control unit 14 delivers a cleaning signal to the cleaner 13, which removes the ink mists or other foreign materials from the ink jet slit while the sheet feeder 11 discharges the recording sheet and the recording head 19 is out of operation. The printer then shits in a standby mode for waiting a next print command.

Figure 3:
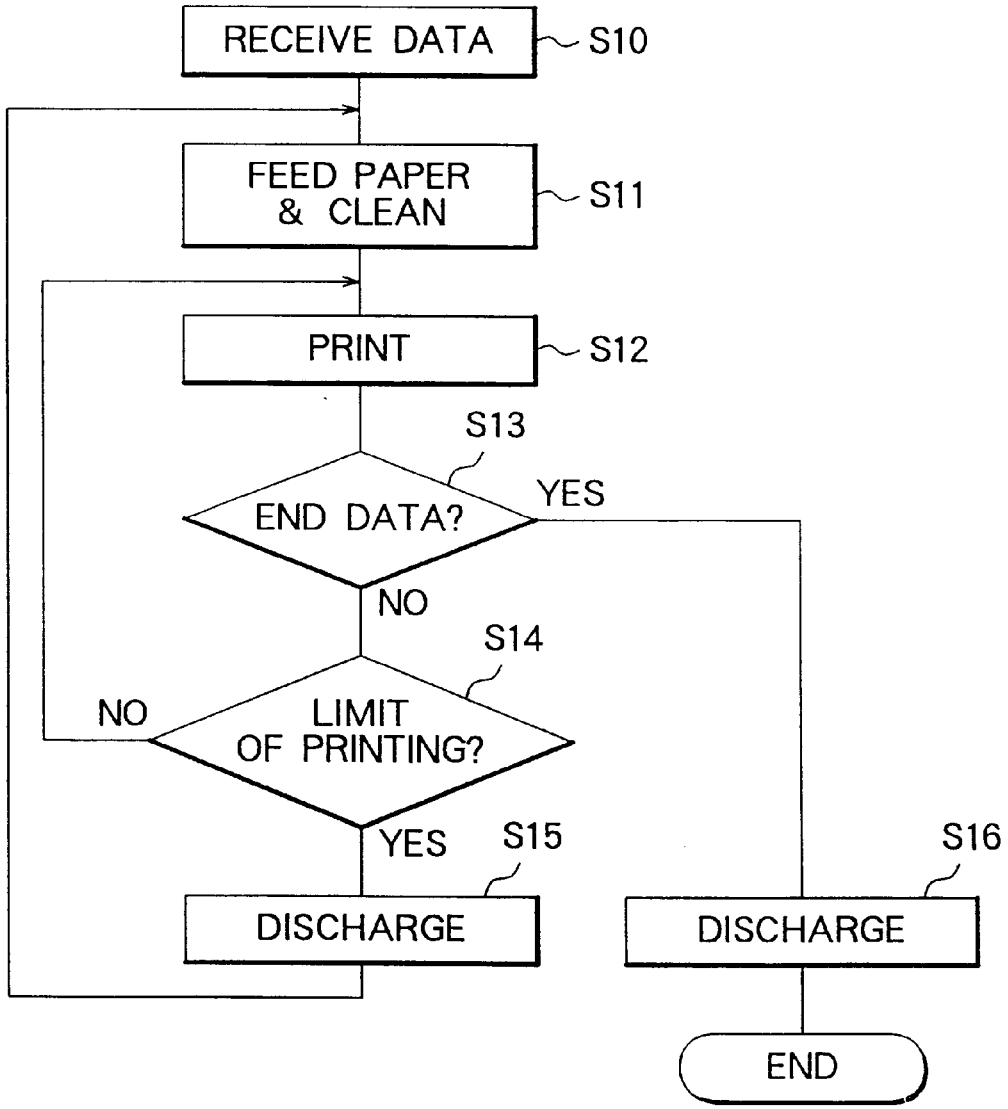
FIG. 3 is another flowchart of the cleaning operation of an ink jet recording device according to a second embodiment of the present invention.

Referring to FIG. 3 showing a flowchart of an ink jet recording device according to a second embodiment of the present invention, the cleaning of the ink jet slit is effected during feed of a recording sheet. The sheet sensor 12 shown in FIG. 1 is disposed at the sheet feed passage.

Upon receiving print data from the host computer 17 at step S10 through the data receiving section 18, the CPU 15 conducts processing based on the print data and supplies a feed command signal to the sheet feeder 11.

The sheet feeder 11 then starts for carrying a recording sheet to the recording head 19 from the sheet tray through the feed passage at step S11. The start of the feed of the recording sheet is detected by the sheet sensor 12. The control unit 14 receives the detected signal from the sheet sensor 12 and delivers a cleaning signal to the cleaner 13 which operates for removing the ink mists or other foreign materials at step S11. The cleaning operation is stopped before the recording sheet arrives at the recording head 19.

The print data stored in the RAM is delivered to the recording head 19 together with a printing mode signal. The recording head 19 ejects ink droplets onto the recording sheet based on the print data while reciprocally moving in the transverse direction of the recording sheet at step S12.

If the next print data is not an end data at step S13, step S14 follows wherein it is judged whether or not the recording head 19 is located at the end of the sheet. If it is judged at step S14 that the recording head 19 is not located at the end of the recording sheet, the process returns to step S11 to repeat the steps S11 through S13. On the other hand, if it is judged at step S14 that the recording head 19 is located at the end of the recording sheet, step S165follows wherein the recording head 19 stops operation and the sheet feeder 11 discharges the sheet on the recording position toward outside the printer. Then, the process returns to step S11 to repeat the steps S11 thorough S13 for a next sheet.

If it is detected at step S13 that the next data in the print data is an end data, the control unit 14 delivers an end signal to the recording head 19 and the sheet feeder 11, as a result of which the recording head 19 stops operation and the sheet feeder 11 discharges the sheet at step 16, to end the printing operation.

In the second embodiment, the timing of the cleaning operation is also determined by the sheet sensor 12. Accordingly, CPU 14 needs not conduct arithmetic processing or counting operation for the cleaning operation.

Figure 4:
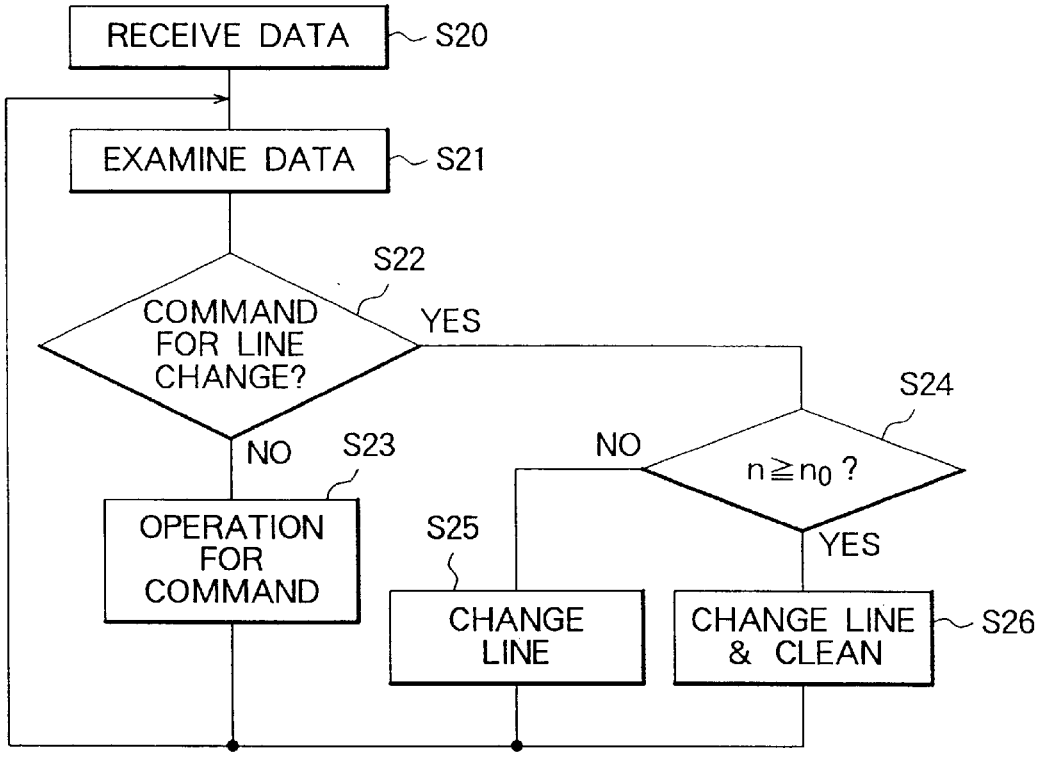
FIG. 4 is another flowchart of the cleaning operation of an ink jet recording device according to a third embodiment of the present invention.

Referring to FIG. 4 showing a flowchart of an ink jet printer according to a third embodiment of the present invention, the timing of the cleaning operation is determined by detecting the mechanical signal for the start of the sheet feeder 11. The signal from the sheet sensor 12 is used for operations other than the cleaning operation.

Upon receiving print data. In step S20, the control unit 14 effects data analysis at step S21 by judging whether the next individual data in the print data is a change line data or data other than the change line data. If it is judged at step S22 that the next individual data is other than the change line data, the control unit 14 executes operation based on the specified data at step S23 and returns to step S21 to repeat the steps S21 and S22. If it is detected at step S22 that the next individual data is a change line data, it is further judged at step S24 whether the operation of the next individual data consumes a period larger than a specified period which corresponds to the time length for execution of cleaning.

If it is judged at step S24 that the next individual data for change line data consumes less than the specified period, the step proceeds to step S25, wherein the operation for the change line is effected. Subsequently, the process returns to step S21 to repeat the steps S21 and S22. On the other hand, if it is judged at step S24 that operation for the next individual data for a change lined data consumes a period more than the specified period, step S26 follows while the recording head 19 is stopped. At this step S26, a cleaning operation is effected concurrently with the change line operation. That is, the cleaner is activated when the sheet feeder effects a change line operation for advancing the recording sheet by a minimum number of lines without discharging the recording sheet beyond the recording head, and wherein the change line operation for the minimum number of lines consumes a period of time more than the specified period. In this manner, the cleaning operation is effected without a necessary for detecting the timing for the cleaning operation by the CPU 15.

Since the above embodiments are described only for examples, the present invention is not limited to the above embodiments and various modifications or alterations can be easily made therefrom by those skilled in the art without departing from the scope of the present invention.

What is claimed is:

1. An ink jet recording device comprising:

a recording head having an ink jet slit for ejecting therethrough ink onto a recording sheet;

a sheet feeder for feeding the recording sheet to or from said recording head;

a cleaner for cleaning said ink jet slit; and a control unit which activates said cleaner in response to a movement of said sheet feeder, wherein said cleaner is activated by said control unit when said sheet feeder effects a change line operation for advancing the recording sheet by a predetermined minimum number of lines without discharging the recording sheet beyond said recording head.

2. The ink jet recording device as defined in claim 1, wherein said cleaner is activated during an interval in time after the recording sheet is initially carried by said sheet feeder toward said recording head and prior to the recording sheet reaching said recording head.

3. The ink jet recording device as defined in claim 2, further comprising a sheet sensor provided along a sheet passage upstream of said recording head.

4. The ink jet recording device as defined in claim 1, wherein said cleaner is activated during an interval in time after the recording sheet is carried by said sheet feeder from said recording head and before a new recording sheet is carried by said sheet feeder to said recording head.

5. The ink jet recording device as defined in claim 4, further comprising a sheet sensor provided along a sheet passage downstream from said recording head.

6. The ink jet recording device as defined in claim 1, wherein said cleaner stops before the recording sheet arrives at said recording head.

7. The ink jet recording device as defined in claim 1, wherein said cleaner is activated by said control unit when said sheet feeder effects a change line operation for advancing the recording sheet by a predetermined minimum number of lines without discharging the recording sheet beyond said recording head, and wherein said change line operation for advancing the recording sheet by a predetermined minimum number of lines consumes a period of time longer than a time for cleaning said ink jet slit.

* * * * *